United States Patent [19]

Rörig et al.

[11] Patent Number: 4,842,771

[45] Date of Patent: Jun. 27, 1989

[54] THICKENED AQUEOUS CLEANING COMPOSITIONS

[75] Inventors: Hans Rörig, Merzenich; Norbert Porta, Nörvenich, both of Fed. Rep. of Germany

[73] Assignee: Akzo N.V., Arnhem, Netherlands

[21] Appl. No.: 102,333

[22] Filed: Sep. 29, 1987

[30] Foreign Application Priority Data

Sep. 29, 1986 [EP] European Pat. Off. ..... 86201667.2

[51] Int. Cl.[4] ..... C11D 1/75; C11D 3/395

[52] U.S. Cl. ..... 252/547; 252/142; 252/558; 252/106

[58] Field of Search ..... 252/8.75, 8.8, 547, 252/142, 558, DIG. 5, DIG. 13, 106

[56] References Cited

U.S. PATENT DOCUMENTS

| | | | |
|---|---|---|---|
| 3,440,063 | 4/1969 | Chestochowski et al. | 427/331 |
| 3,496,110 | 2/1970 | Shumway et al. | 252/142 |
| 3,560,389 | 2/1971 | Hunting | 252/95 |
| 3,892,669 | 7/1975 | Rapisarda | 252/8.75 |
| 3,943,234 | 3/1976 | Roggenkamp | 424/343 |
| 3,993,575 | 11/1976 | Howanitz et al. | 252/142 |
| 3,997,453 | 12/1976 | Wixon | 252/8.75 |
| 4,111,854 | 9/1978 | Spadini et al. | 252/541 |
| 4,271,030 | 6/1981 | Brierley et al. | 252/98 |
| 4,304,932 | 12/1981 | Phillips et al. | 562/561 |
| 4,666,615 | 5/1987 | Disch et al. | 252/11 |
| 4,683,008 | 7/1987 | Betts | 134/27 |

FOREIGN PATENT DOCUMENTS

| | | |
|---|---|---|
| 0125103 | 11/1984 | European Pat. Off. . |
| 0130786 | 1/1985 | European Pat. Off. . |
| 0137871 | 4/1985 | European Pat. Off. . |
| 0144166 | 6/1985 | European Pat. Off. . |
| 0204472 | 12/1986 | European Pat. Off. . |
| 206375 | 12/1986 | European Pat. Off. . |
| 2459830 | 6/1979 | France . |
| 489976 | 3/1980 | Spain . |
| 0948396 | 2/1964 | United Kingdom . |
| 1240469 | 7/1971 | United Kingdom . |
| 1294642 | 11/1972 | United Kingdom . |
| 1349567 | 4/1974 | United Kingdom . |
| 1408525 | 10/1975 | United Kingdom . |
| 1443244 | 7/1976 | United Kingdom . |
| 2010892 | 7/1979 | United Kingdom . |
| 2012837 | 8/1979 | United Kingdom . |

OTHER PUBLICATIONS

Chemical Abstract, vol. 91, 1979, Abstract No. 22828g.

Chemical Abstract, vol. 105, 1986, Abstract No. 174867q.

G. E. Totten, et al., "Counterion Effects on the Aqueous Solution Viscosity of Cationic Surfactants", JAOCS, vol. 63, No. 12, Dec. 1986.

*Primary Examiner*—Paul Lieberman

*Assistant Examiner*—John F. McNally

*Attorney, Agent, or Firm*—Oliff & Berridge

[57] ABSTRACT

The invention relates to an aqueous composition incorporating quaternary ammonium salt or amine oxide surfactant and cumene sulphonate, xylene sulphonate, toluene sulphonate or mixtures thereof and displaying pronounced shear thinning behaviour, i.e., exhibiting high viscosities at low rates of shear and intended to be applied to non-horizontal structural surfaces.

These compositions comprise:

a. from 0.1% to 10% by weight of a surfactant selected from the group consisting of quaternary ammonium compounds and tertiary amine oxides, b. from 0.01% to 3% by weight of an organic anionic sulphonate selected from the group consisting of cumene sulphonate, xylene sulphonate, and toluene sulphonate, in their acid or salt form, and mixtures thereof, and c. water, wherein optionally one or more cleaning, disinfecting and/or odourizing agents may be dissolved or dispersed.

Acid-containing compositions are preferred and more particularly those containing 1–10% by weight of citric acid or hydrochloric acid. The invention also relates to thickening compositions, containing above-mentioned nitrogen containing surfactant and the sulphonate and to processes of cleaning non-horizontal surfaces.

10 Claims, No Drawings

THICKENED AQUEOUS CLEANING COMPOSITIONS

FIELD OF THE INVENTION

The invention relates to aqueous compositions incorporating low levels of quaternary ammonium salt or amine oxide surfactant and displaying pronounced shear thinning behaviour, i.e. exhibiting high viscosities at low rates of shear.

This type of behaviour is of particular advantage in cleaning compositions intended to be applied to non-horizontal structural surfaces such as walls and windows and sanitary fittings such as sinks, baths, showers, wash basins and lavatories.

The invention is especially concerned with aqueous acid-containing cleaning compositions which are commonly applied to the surfaces of sanitary fittings.

BACKGROUND OF THE INVENTION

It is well known that the higher the viscosity of a liquid composition, the greater will be its residence time when applied to a non-horizontal surface such as a wall. This viscosity can be increased in many ways. Especially for compositions containing a hypochlorite bleach, a variety of formulations have been proposed, but thickening systems have also been proposed for aqueous cleaning compositions of a pH not higher than 7.0.

GB No. 1,240,469, for instance, discloses compositions, suitable for cleaning metal, glass and painted surfaces, which compositions have a pH not higher than 7.0 and comprise (a) an inorganic acid, an organic acid or an acidic salt (b) a cationic detergent and (c) a water insoluble or partially water soluble covalent compound other than the compounds under (b) and which contains oxygen or halogen and at least one hydrocarbon chain of at least four carbon atoms.

As component (c) can more particularly be used an ester of an inorganic acid, a fatty acid or an ester of a fatty acid, a carboxylic acid ester in which the hydrocarbon chain derived from the alcohol has at least four carbon atoms, an alkyl chloride, a hydroxyl compound or substituted hydroxy compound, and the hydroxy compound is preferably water insoluble, such as a fatty alcohol, containing from 4–30 carbon atoms in at least one alkyl chain.

As cationic detergent only an amine oxide of a special structure is mentioned, which is exemplified by a large number of representatives, the actual application of quaternary ammonium salts being neither disclosed in general terms, nor in specifically exemplified representatives.

U.S. Pat. No. 3,997,453 discloses a stable, cold water dispersible fabric softening composition comprising from about 60 to 20% by weight of a cationic quaternary ammonium softener, an organic anionic sulfonate, the weight ratio of the cationic softener to the anionic detergent being from about 40:1 to 5:1 and wherein the anionic sulphonate being selected from amongst benzene or naphthalene sulphonate or a polyalkyl substituted aromatic sulphonate with one of the alkyl groups having not more than 18 C-atoms and each of the remaining alkyl group having not more than 2 carbon atoms.

Considering the statements in U.S. Pat. No. 3,997,453, lines 42–45 and lines 57–64 of column 1, it is clear that a person skilled in the art would only be led away from trying to use combinations of cationic quaternary compounds and an anionic sulphonate as thickening composition. A person skilled in the art was even fortified in that prejudice on account of Kunishov et al, Tr. Mezhdunar. Kongr. Paverkhn.—Akt. Veshchestvam, 7 th 1976 (publ. 1978), 3, 150–8, Nats. Komm. SSSR Poverchn.—Akt. Veschchestvam Moscow, USSR.

From e.g. Journal of Colloid and Interface Science, vol. 57, no. 3, December 1976, 575–577; Journal of Physical Chemistry, vol. 83, no. 17, 1979, 2232–2236; Ber. Bunsenges. Phys. Chem. 85, 255–276 (1981) and ibidem 86, 37–42 (1982) a great interest appears for research relating to viscoelastic surfactant solutions, containing a quaternary ammonium compound derived from salicylic acid, m-chlorobenzoic acid and p-chlorobenzoic acid, while moreover from Journal of Colloid and Interface Science, vol. 57, no. 3, December 1976, page 576 and from Wan. L.S.C., J. Pharm. Sci. 55, 1395 (1966) it could anyhow be derived by a skilled person that the desired increase in viscosity could not generally be obtained in the pH range of from 1.6 to 2.5, depending on the organic acid to be applied with, e.g., cetyl trimethyl ammonium bromide.

Moreover, the continued exceptional interest taken in the last few years in the rheological properties of aqueous compositions, containing quaternary ammonium ions and salicyclic acid and some sulphonates of alkyls, clearly appears from, e.g., Seifen-ole-Fetten-Wachse-111 Jg. No. 15/1985, 467–471 and 200–202 and Journal of Colloid and Interface Science, Vol. 106, No. 1, July 1985, 222–225, whereas from the European patent applications Nos. 0,144,166 and 0,137,871 it appears that people skilled in the art, when looking for alternative improved thickening systems, also began to consider the application of tertiary amine oxides in certain specific compositions.

It will be appreciated from these two patent applications, that the former prejudice that cumene sulphonates, xylenes sulphonates or toluene sulphonates and the like were far from attractive for use in thickening compositions of aqueous solutions, continued to exist.

More particularly, from lines 5–8 of page 3 and lines 4–25 and more particularly lines 11 and 12 of page 5 of EP No. 0,137,871, it appears that skilled people were primarily looking for other combinations of specific amine oxides and anionic surfactants which are substantially different from cumene sulphonate, xylene sulphonate, toluene sulphonate and which have a more complex structure and are therefore more difficult to handle. Moreover, such compounds are higher in price.

As result of extensive research and experimentation it has suprisingly been found now that improved thickened aqueous single phase compositions could be obtained, which comprise:

(a) from 0.1% to 10% by weight of a surfactant selected from the group consisting of (1) quaternary ammonium compounds, wherein at least one of the hydrocarbon groups linked to nitrogen is a linear or branched alkyl group containing at least 12 carbon atoms and preferably 16–20 carbon atoms, and being saturated or unsaturated, and wherein two or three of the groups linked to the nitrogen are independently optionally substituted alkyl groups which contain 1 to 6 carbon atoms, and wherein one or more of said alkyl groups may contain an aryl substituent or may be replaced with an aryl group, and wherein an anion may be present such as halide, acetate, methosulphate, and the like, and (2) tertiary amine oxides wherein at least one of the hydrocarbon groups linked to nitrogen is a linear or a branched alkyl group containing at least 16 carbon atoms and preferably 16–20 carbon atoms being saturated or unsaturated and wherein two of the groups linked to the nitrogen are independently optionally substituted alkyl groups which contain 1–6 carbon atoms and wherein one or more said alkyl groups may contain an aryl substituent or may be replaced by an aryl group, (b) from 0.01% to 3% by weight of an organic, anionic sulphonate selected from the group consisting of cumene sulphonate, xylene sulphonate, and toluene sulphonate, in their acid or salt form, and mixtures there of, and (c) water, wherein optionally one or more cleaning, disinfecting and/or odorizing agents may be dissolved or dispersed, the percentages by weight being calculated on the weight of the total aqueous composition.

Examples of such cleaning, disinfecting and/or odorizing agents are auxiliary detergents, acids, detergent builder salts, perfumes, antibiotics or active chlorine providing means.

A preferred embodiment of the present invention is formed by thickened aqueous cleaning compositions having a pH of not more than 7 and preferably between 0 and 6 and more preferably between 0–4, and containing 1–15% by weight of an acid, normally occurring in cleaning compositions.

Typical examples of quaternary ammonium compounds referred to under (a) are:
ethyl-dimethyl-stearyl ammonium chloride,
ethyl-dimethyl-stearyl ammonium bromide
cocoalkyl-trimethyl ammonium chloride,
hydrogenated tallow-trimethyl ammonium chloride,
hydrogenated tallow-trimethyl ammonium bromide
stearyl-trimethyl ammonium chloride,
stearyl-trimethyl ammonium bromide,
trimethyl-cetyl ammonium bromide,
dimethyl-ethyl-lauryl ammonium chloride,
tallow trimethyl ammonium chloride,
tallow trimethyl ammonium bromide,
propyl-myristyl ammonium chloride and the corresponding methosulphates, acetates, and the like.

A preferred group of the cationic ammonium compounds are:
(hydrogenated) tallow-trimethyl ammonium chloride,
(hydrogenated) tallow-trimethyl ammonium bromide,
tallow trimethyl ammonium bromide,
tallow trimethyl ammonium chloride,
soja alkyl-trimethyl ammonium chloride,
soja alkyl-trimethyl ammonium bromide,
cetyl-trimethyl ammonium chloride, and
methyl-bis(2-hydroxy ethyl)oleyl ammonium chloride.

Most preferably tallow-trimethyl ammonium chloride is used.

Typical examples of tertiary amine oxides referred to under (a) are:
bis(2-hydroxy ethyl) cetylamine oxide,
bis(2-hydroxy ethyl) tallowamine oxide,
bis(2-hydroxy ethyl) hydrogenated tallow amine oxide,
bis(2-hydroxy ethyl) stearylamine oxide,
bis(2-hydroxy propyl) tallowamine oxide,
bis(2-hydroxy propyl) stearyl amine oxide,
dimethyl tallowamine oxide,
dimethyl cetylamine oxide,
dimethyl stearylamine oxide, and
di-ethyl stearylamine oxide.

A preferred group of the amine oxides are:
dimethyl cetylamine oxide, and
bis(2-hydroxy ethyl) tallowamine oxide.

Most preferably bis(2-hydroxy ethyl) tallowamine oxide is used.

The amine oxide and/or quaternary ammonium compound may preferably be used in amounts from 0.1% to 5% by weight based on the total weight of the composition dependent on the viscosity and the type of the agent desired.

A preferred embodiment of the present invention is formed by thickened compositions containing one or more salts of the specified sulphonates. Typical salts of the sulphonates specified under (b) are the sodium, potassium, ammonium, lower amine and alkanolamine salts, of which the sodium salts are preferred.

Typical acids which may be applied in the compositions of the present invention are sulphuric acid, phosphoric acid, sulphamic acid, hydrochloric acid, citric acid, acetic acid, formic acid or an acidic salt of the type conventionally used in cleaning compositions, or combinations thereof in an amount of from 1–15%.

More preferably, citric acid or hydrochloric acid should be used in an amount from 1–10% by weight, based on the total composition. The compositions according to the present invention exhibit a viscosity of at least 200 n.Pa.s at 20° C.

For compositions exhibiting optimum thickening effects, the ratio of the weights of the quaternary ammonium compound or tertiary amine oxide to the sulphonate is in the range from 0.1–6 and preferably from 1.5–2.5 and more preferably around about 2.0.

A preferred embodiment of the invention is formed by the thickened cleaning composition which comprises:

| | | |
|---|---|---|
| a | tallow trimethyl ammonium chloride (as 50% solution Arquad T50 ®) | 2.24% by weight |
| b | sodium xylenesulphonate (40%) | 1.26% by weight |
| c | citric acid monohydrate | 5% by weight |
| d | Perfume Floral Rose (IFF) | 0.1% by weight |
| e | water | 91.4% by weight |

which showed the following viscosity values at different shear rates, using a Haak Rotovisco RV 100 viscosimeter.

| shear rate $sec^{-1}$ | viscosity m Pa.s. at 20° C. |
|---|---|
| 0.1 | 300 |
| 0.3 | 200 |
| 3 | 130 |
| 30 | 87 |
| 300 | 18 |

The thickening systems described above display a viscosity temperature relationship that has a parabolic profile with the maximum viscosity being exhibited at a temperature in the range from 0° C. to 30° C. An increase in chain length of higher alkyl chain in the quaternary ammonium ion or amine oxide in general increases the temperature at which this peak occurs while a reduction in this higher alkyl chain length and/or branching in this alkyl group, reduces the temperature at which the maximum viscosity is produced by the system.

It will be appreciated by persons skilled in the art that the ideal situation, wherein the viscosity of the composition should be independent of temperature over a temperature range which encompasses the practical domestic use conditions, i.e., from 5°–25° C., is approached most closely by the compositions of the present invention, employing a blend of surfactants and specific sulphonate(s), the application of which would certainly be rejected by persons skilled in the art.

It will be appreciated by persons skilled in the art that the optimal characteristics of the compositions of the present invention will be governed by the specific kind of surfactant (quaternary ammonium ion or amine oxide), kind of sulphonate, kind of acid in the composition, amount of acid electrolyte concentration in total composition, ratio of weights of the surfactant-sulphonate combinations, and counter ion of the sulphonates. The thickening compositions according to the present invention have however appeared to be rather insensitive to other types of ingredients occurring in the complete aqueous cleaning composition, such as perfume.

For example, for optimal results, the weight ratio of tallow trimethyl ammonium chloride and sodium xylene sulphonate in citric acid solution of 4.5% by weight (100%), i.e., 5% of hydrated citric acid, may vary from 2.0–2.5, and more preferably 2.15–2.25, while acceptable compositions for practical purposes may show ratios from 0.5–4.0 (based on 100% ingredients).

It will be appreciated that another feature of the invention is formed by a thickening premix composition, which comprises at least:

(a) a surfactant selected from the group consisting of quaternary ammonium compounds and tertiary amine oxides as defined hereinbefore, and (b) an organic, anionic sulphonate selected from the group consisting of cumene sulphonate, xylene sulphonate, and toluene sulphonate, in their acid or salt form, and mixtures thereof, in a weight ratio of both ingredients as indicated before.

The application of such thickening premix compositions has appeared to be rather insensitive to the presence of other ingredients in the final cleaning composition, e.g., perfume.

Such thickening premix compositions have been found to consist of homogeneous mixtures of components (a) and (b) and to exhibit a long storage stability. When mixed with water or an aqueous solution they display a surprising thickening effect.

Another feature of the present invention is formed by the application of the thickened aqueous single phase compositions according to the usual methods of this specific art of cleaning non-horizontal surfaces such as walls, windows and sanitary fittings.

The invention is illustrated by the following examples but not with the intention to restrict its scope to these embodiments.

EXAMPLE 1

Preparation of thickened cleaning composition comprising xylene sulphonate and tallow trimethyl ammonium chloride.

Citric acid monohydrate (5.0 g) is dissolved in about 85.0 ml of demineralized water, with stirring, at 20° C., whereafter 2.2 g of tallow trimethyl ammonium chloride (as 50% solution Arquad T 50®) are added, followed by the addition of 1.25 g of sodium xylene sulphonate (as 40% solution), with continued stirring. The viscosity increases immediately during the addition of the sulphonate. After addition, with stirring, of 0.001 g of Acidol Blau BE/NW® dye previously dissolved in 6.5 ml of demineralized water and 0.1 g of Floral Rose® Perfume, stirring is continued until the perfume is completely dispersed (about 1–15 min., dependent on the type of applied perfume).

To facilitate dispersion of the perfume in the finished composition the perfume may be mixed with the tallow trimethyl ammonium chloride.

The obtained composition comprises:

2.2 % by weight of tallow trimethyl ammonium chloride (50%)
1.25 % by weight of sodium xylene sulphonate (40%)
5.0 % by weight of hydrated citric acid
0.001% by weight of dye (Acidol Blue BE/NW)
0.1 % of perfume
and water to 100%.

The composition shows a good viscosity and is completely clear and stable at elevated temperature (40° C.). The colour does not change during storage.

The viscosity was measured by Brookfield LVT, 60 rpm, 230 m Pa.s (20° C.). The composition did not show any cloud point on cooling down to 0° C., and on heating up to 95° C.

EXAMPLE 2

Starting from a thickening premix composition containing 64% by weight of tallow trimethyl ammonium chloride (Arquad T 50®) and 36% by weight of sodium xylene sulphonate (40%), the compositions given in the following table were prepared as described in Example 1:

| acid | percentage by weight of Arquad T 50® | percentage by weight of xylene-sulph 40% | viscosity in m Pa.s. 20° C. |
|---|---|---|---|
| 7.5% hydrochloric acid | 2.24 | 1.26 | 220 |
| 5% sulphuric acid | 1.92 | 1.08 | 220 |
| 5% phosphoric acid | 1.92 | 1.08 | 300 |
| 10% sulphamic acid | 1.92 | 1.08 | 330 |
| 5% hydrated citric acid | 1.92 | 1.08 | 230 |
| 5% formic acid | 1.92 | 1.08 | 125 |

The viscosities were measured by using a Brookfield LVT 60 rpm.

EXAMPLE 3

Compositions were prepared containing respectively:

| I | II |
|---|---|
| 1.5% tallow trimethyl ammonium chloride (Arquad T 50®) | 1.91% Arquad T 50® |
| 0.5% salicylic acid | 1.07% sodium xylene sulphonate (40%) |
| 5.0% hydrated citric acid and water to 100% | 5.0% citric acid monohydrate and water to 100% |

All indicated percentages are by weight, based on the weight of the total composition.

As to the addition of perfume to both compositions, composition I was reported as becoming cloudy and thin, while composition II remained clear and had a viscosity of 190 m Pa.s. at 20° C. The same behaviour could be observed in the case of similar compositions containing sodium cumene sulphonate or sodium toluene sulphonate, showing a rather small perfume susceptibility which permits the use of premix compositions derived from sulphonate-quaternary ammonium derivatives.

Whereas composition I did not show significant thickening effects in e.g., 10% HCl and 5% $H_2SO_4$, composition II could be applied in all acids specified in Example 2.

EXAMPLE 4

Compositions were prepared along the lines of the process described in Example 1, starting from bis(2-hydroxy ethyl) tallowamine oxide (Aromox T12®) in amounts from 3 7% by weight, sodium xylene sulphonate, sodium toluene sulphonate, sodium cumene sulphonate, or secondary n-alkane sulphonates of the formulae $$R-\underset{\underset{SO_3Na}{|}}{CH}-R^1 \text{ and } R-SO_3Na$$

wherein R and $R^1$ represent an alkane residue of from 13–18 carbon atoms (Hostapur® SAS wherein $C_{13}$-n-alkanesulphonate represents 3% of the composition, $C_{14}$-n-alkanesulphonate 25%, $C_{15}$-n-alkanesulphonate 30%, $C_{16}$-n-alkanesulphonate 25, $C_{17}$-n-alkanesulphonate 15% and $C_{18}$-n-alkanesulphonate 2%, being an example of a composition according to EP-0 137 871) in amounts of from 0–2% by weight, and hydrated citric acid, hydrochloric acid, formic acid, phosphonic acid, sulphuric acid and amidesulphonic acid.

Comparison of the viscosity values at 20° C. of above prepared aqueous compositions containing varying amounts of the amine oxides (from 3 7% by weight) clearly showed that combination I, consisting of amine oxide and sodium salts of xylene sulphonate, toluene sulphonate, or cumene sulphonate, exhibited significantly better thickening characteristics than combination II consisting of amine oxide and n-alkane sulphonate (according to relevant prior art).

Moreover, the thickening properties of compositions containing amine oxide and olefin sulphonates (e.g., ELFAN OS46®) III showed inferior thickening properties as compared with combination I and moreover had an intensive yellow colour.

Among the tested compositions the amine oxide (Aromox T12®) and sodium xylene sulphonate showed the most attractive characteristics.

We claim:

1. A thickened aqueous single phase cleaning composition comprising:

a. from 0.1% to 10% by weight of a surfactant selected from the group consisting of (1) quaternary ammonium compounds wherein at least one of the hydrocarbon groups linked to nitrogen is a linear or branched alkyl group containing at least 12 carbon atoms being saturated or unsaturated and wherein two or three of the groups linked to the nitrogen are independently unsubstituted or substituted alkyl groups which contain 1 to 6 carbon atoms and wherein one or more said alkyl groups may contain an aryl substituent or may be replaced by an aryl group and wherein an anion may be present such as halide, acetate, methosulphate and the like, and (2) tertiary amine oxides wherein at least one of the hydrocarbon groups linked to nitrogen is a linear or a branched alkyl group containing at least 16 carbon atoms being saturated or unsaturated and wherein two of the groups linked to the nitrogen are independently unsubstituted or substituted alkyl groups which contain 1–6 carbon atoms and wherein one or more said alkyl groups may contain an aryl substituent or may be replaced by an aryl group, b. from 0.01% to 3% by weight of an organic anionic sulphonate selected from the group consisting of cumene sulphonate, xylene sulphonate, and toluene sulphonate in their acid or salt form and mixtures thereof, c. from 1 to 15% by weight of an acid, and d. water, wherein one or more cleaning, disinfecting and/or odorizing agents may be dissolved or dispersed, the percentage by weight being calculated on the weight of the total aqueous composition, and the pH of said composition being from 0 to 6.

2. The thickened aqueous cleaning composition of claim 1 characterized in that the pH is between 0 and 4.

3. The thickened aqueous composition according to claim 1, characterized in that they contain at least tallow trimethyl ammonium chloride.

4. The thickened composition according to claim 1 characterized in that they contain a quaternary ammonium compound in an amount from 0.1 to 5.0% by weight based on the total weight of the composition.

5. The thickened composition according to claim 1 characterized in that they contain the sodium salt of the sulphonates.

6. The thickened compositions according to claim 5 characterized in that they contain the sodium salt of xylene sulphonate.

7. A thickening premix composition, for the preparation of the compositions according to claim 1, comprising:

a. a surfactant selected from the group consisting of quaternary ammonium compounds, wherein at least one of the hydrocarbon groups linked to nitrogen is a linear or branched alkyl group containing at least 12 carbon atoms and being saturated or unsaturated and wherein two or three of the groups linked to nitrogen are independently unsubstituted or substituted alkyl groups which contain 1 to 6 carbon atoms and wherein one or more said alkyl groups may contain an aryl substituent or may be replaced by an aryl group and wherein an anion may be present such as halide, acetate, methosulphate or the like, and b. an organic anionic sulphonate selected from the group consisting of cumene sulphonate, xylene sulphonate, and toluene sulphonate, in their acid or salt form, and mixtures thereof.

8. The thickening premix composition according to claim 7, characterized in that the ratio of the weights of the quaternary ammonium compound to the sulphonate is in the range from 1.5–2.5.

9. The thickening premix composition according to claim 7 characterized in that they contain at least tallow trimethyl ammonium chloride.

10. A process for cleaning non-horizontal surfaces such as walls, windows and sanitary fittings by the application of the thickened aqueous single phase cleaning compositions according to claim 1 by methods usual in the art.

* * * * *